US006255995B1

(12) United States Patent
Asano et al.

(10) Patent No.: US 6,255,995 B1
(45) Date of Patent: Jul. 3, 2001

(54) PATCH ANTENNA AND ELECTRONIC EQUIPMENT USING THE SAME

(75) Inventors: Takeshi Asano, Atsugi; Akihisa Sakurai, Sagamihara, both of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/451,975

(22) Filed: Nov. 30, 1999

(30) Foreign Application Priority Data

Dec. 24, 1998 (JP) ..... 10-366757

(51) Int. Cl.[7] ..... H01Q 1/38
(52) U.S. Cl. ..... 343/700 MS; 343/846
(58) Field of Search ..... 343/700 MS, 846, 343/848, 829, 845; H01Q 1/38

(56) References Cited

U.S. PATENT DOCUMENTS 5,798,734 * 8/1998 Ohtsuka et al. ..... 343/846
5,986,615 * 11/1999 Westfall et al. ..... 343/846
6,124,830 * 9/2000 Yuanzhu ..... 343/848

FOREIGN PATENT DOCUMENTS

447218A2 9/1991 (EP) .
801436A2 10/1997 (EP) .
924796A2 12/1998 (EP) .
9260933 10/1997 (JP) .
WO9532528 11/1995 (WO) .

* cited by examiner

*Primary Examiner*—Hoanganh Le
(74) *Attorney, Agent, or Firm*—F. Chau & Associates, LLP

(57) ABSTRACT

A patch antenna 1 is comprised of a ground plate 3 provided on one surface of a dielectric plate 2, along with a patch 4 and a feeding line 5 for connection to the patch 4, each being provided on the other surface of the dielectric plate 2. In this patch antenna 1, an aperture 7 is provided on the ground plate 3 at a position, which is asymmetric about a center of the ground plate 3. By virtue of placing the aperture 7 on the ground plate 3 in an asymmetrical manner about the center of the ground plate 3, distribution of a return current becomes so asymmetric as to yield a common mode current. In this way, it is possible to implement the non-directional and broad-bandwidth characteristics.

5 Claims, 6 Drawing Sheets

PATCH ANTENNA AND ELECTRONIC EQUIPMENT USING THE SAME

BACKGROUND

1. Technical Field

This invention relates to a patch antenna that is primarily used for mobile communications or wireless local area networks (LAN), and to electronic equipment that utilizes the same.

2. Description of Related Art

As a small planar antenna for mobile communication or wireless LAN, a microstrip antenna or a patch antenna with a thickened strip has been widely used. FIG. 6 shows an exemplary structure of such a patch antenna. In the example shown in FIG. 6, a patch antenna 51 comprises a dielectric plate 52, a ground plate 53 provided on entire one surface of the dielectric plate 52, a patch 54 provided on the other surface of the dielectric plate 52, and a feeding line 55 provided on the other surface of the dielectric plate 52 for connection to the patch 54. Further, a numeral 56 shows a feed point for feeding power to the feeding line 55 and ground plate 53.

The patch antenna 51 of the aforesaid structure has an advantage that it is small and thin, hence, it does not take a large space. However, in case of using it as an antenna for mobile communication such as mobile computing or as an antenna for wireless communication for connecting a computer to a network, there have been problems in that it has not only narrow directivity due to the ground plate 53 provided on one surface of the dielectric plate 52, but also a narrow frequency bandwidth due to a high Q value. Namely, if such a patch antenna has narrow directivity and yet narrow frequency bandwidth, it is required to direct the antenna toward its communication counterpart at the time of wireless communication, or to specify a direction of the antenna at the time of installing electronic equipment such as a computer. Apparently, these problems have rendered such a patch antenna impractical. To this end, what has been desired in the field of mobile communication or wireless LAN is to improve the conventional patch antenna such that it is substantially non-directional and yet it has a broader frequency bandwidth.

On the other hand, a technique has been proposed to provide an aperture on a patch antenna for lengthening its current path, thereby to downsize the antenna. It is also known to provide an aperture on the ground plate, thereby to feed power from a strip line to the antenna by means of electromagnetic coupling. Further, Japanese Patent Publication 10-22723 discloses a technique for forming notches on a ground electrode (ground plate) to suppress a distinctly polarized wave; Japanese Patent Publication 10-233617 discloses a technique for improving an inverted-F shaped planar antenna by making use of a ground plane with an aperture (ground plate); and Japanese Patent Publication 7-46033 discloses a technique for forming a pair of slots on a ground plane element (ground plate) to provide a two-frequency or multifrequency capability. However, even with these techniques, it has been unable to implement the non-directional and broad-bandwidth characteristics of a patch antenna.

Therefore a need exists for a patch antenna having non-directional and broad-bandwidth characteristics.

SUMMARY OF THE INVENTION

A patch antenna is described, having a ground plate provided on one surface of a dielectric plate, and further having a patch and a feeding line connected to the patch each provided on the other surface of the dielectric plate. The improvement comprising an aperture being provided on the ground plate at a position that is asymmetric about the center of the ground plate.

BRIEF DESCRIPTION OF THE DRAWINGS

This disclosure will present in detail the following description of preferred embodiments with reference to the following figures wherein.

DETAILED DESCRIPTION OF PREFERRED EMBODIMENTS

Figure 1A:
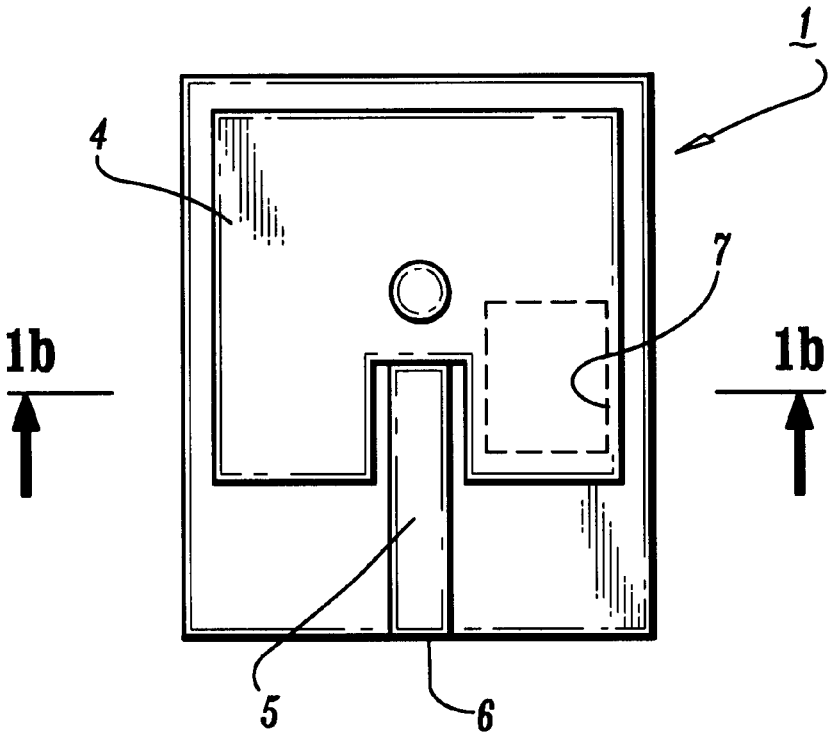
FIGS. 1(*a*) and 1(*b*) are a plan view and a cross-sectional view of an exemplary structure of a patch antenna of this invention.
Figure 1B:
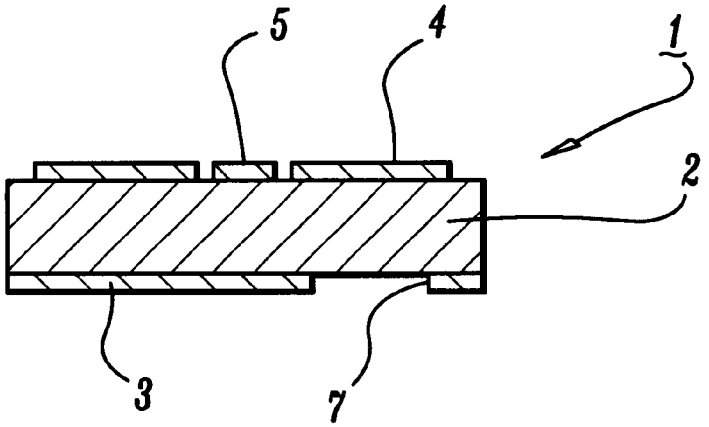

FIGS. 1(*a*) and 1(*b*) show an exemplary structure of a patch antenna 1 of this invention. More particularly, FIG. 1(*a*) is a plan view of the patch antenna 1, whereas FIG. 1(*b*) is a cross-sectional view of the patch antenna 1, taken across the line A—A if FIG. 1(*a*). In the example of FIGS. 1(*a*)and 1(*b*), the patch antenna 1 comprises a dielectric plate 2, a ground plate 3 provided on one surface of the dielectric plate 2, a patch 4 of a predetermined pattern provided on the other surface of the dielectric plate 2, and a feeding line 5 provided on the other surface of the dielectric plate 2 to the patch 4. Further, a numeral 6 shows a feed point for feeding power to the feeding line 5 and ground plate 3. The just described structure is the same as that of the conventional patch antenna. This invention is characterized in that an aperture 7 is provided on the ground plate 3 at a position, which is asymmetric about a center O of the ground plate 3.

In the example of FIGS. 1(*a*)and 1(*b*), as a preferred embodiment, the aperture 7 is placed on the ground plate 3 at a position in close proximity to the feeding line 5 where an electric field is relatively strong. Also, the aperture 7 is selected to have a rectangular shape. Further, a circumferential length along the aperture 7 is set to be substantially equal to one wavelength of a resonant frequency of the patch antenna 1. Moreover, the patch 3 is logically divided into two halves in each of directions being parallel and perpendicular to the feeding line 5 respectively to form four areas altogether, whereby the aperture 7 is placed in either one of the two areas closer to the feeding line 5.

In this invention, by virtue of providing the aperture 7 on the ground plate 3 in an asymmetrical manner about the center of the ground plate 3, the characteristics of the patch antenna 1 are maintained and yet distribution of a return current is so asymmetric as to yield a common mode current. In this way, it is possible to implement the non-directional and broad-bandwidth characteristics of the patch antenna 1.

Also, if a circumferential length along the aperture 7 is set to be substantially equal to one wavelength of a resonant frequency of the patch antenna 1, respective resonance at the relevant frequencies is superposed together, thereby to improve the output or receiving efficiency.

Materials of the dielectric plate 2, ground plate 3, patch 4 and feeding line 5, which constitute the patch antenna 1 of this invention, are not specifically limited to particular materials. This is because any of those materials, which have been conventionally used for these components, may be used in the same manner as before.

Figure 2:
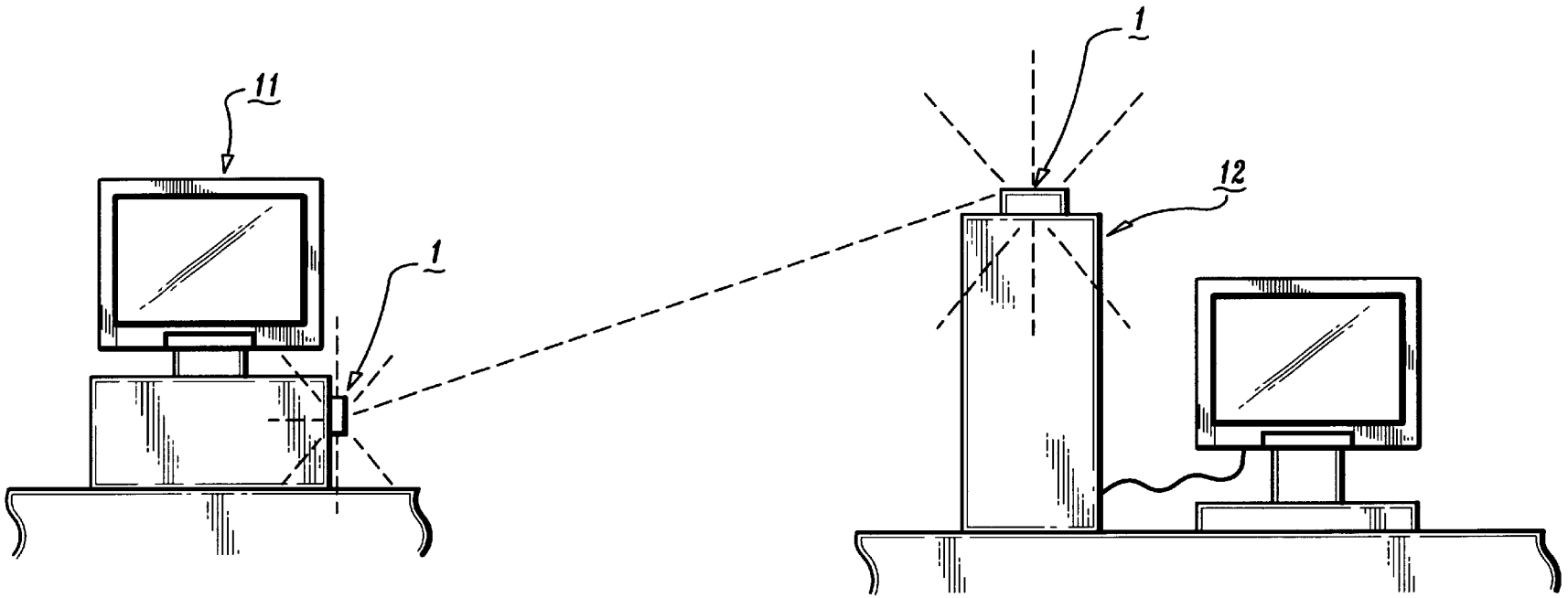
FIG. 2 is a diagram for explaining an example of electronic equipment using a patch antenna of this invention.

FIG. 2 is a diagram for explaining an example of electronic equipment using a patch antenna of this invention. More particularly, FIG. 2 shows such an example where a personal computer 11 as a terminal is interconnected with a host computer 12 by way of a wireless LAN. In this environment, if the aforesaid patch antenna 1 of this invention is used as an antenna for each of the personal computer 11 and host computer 12, it is possible to place the personal computer 11 and host computer 12 without worrying about mounting or fixing positions of the patch antennasi.

Figure 3:
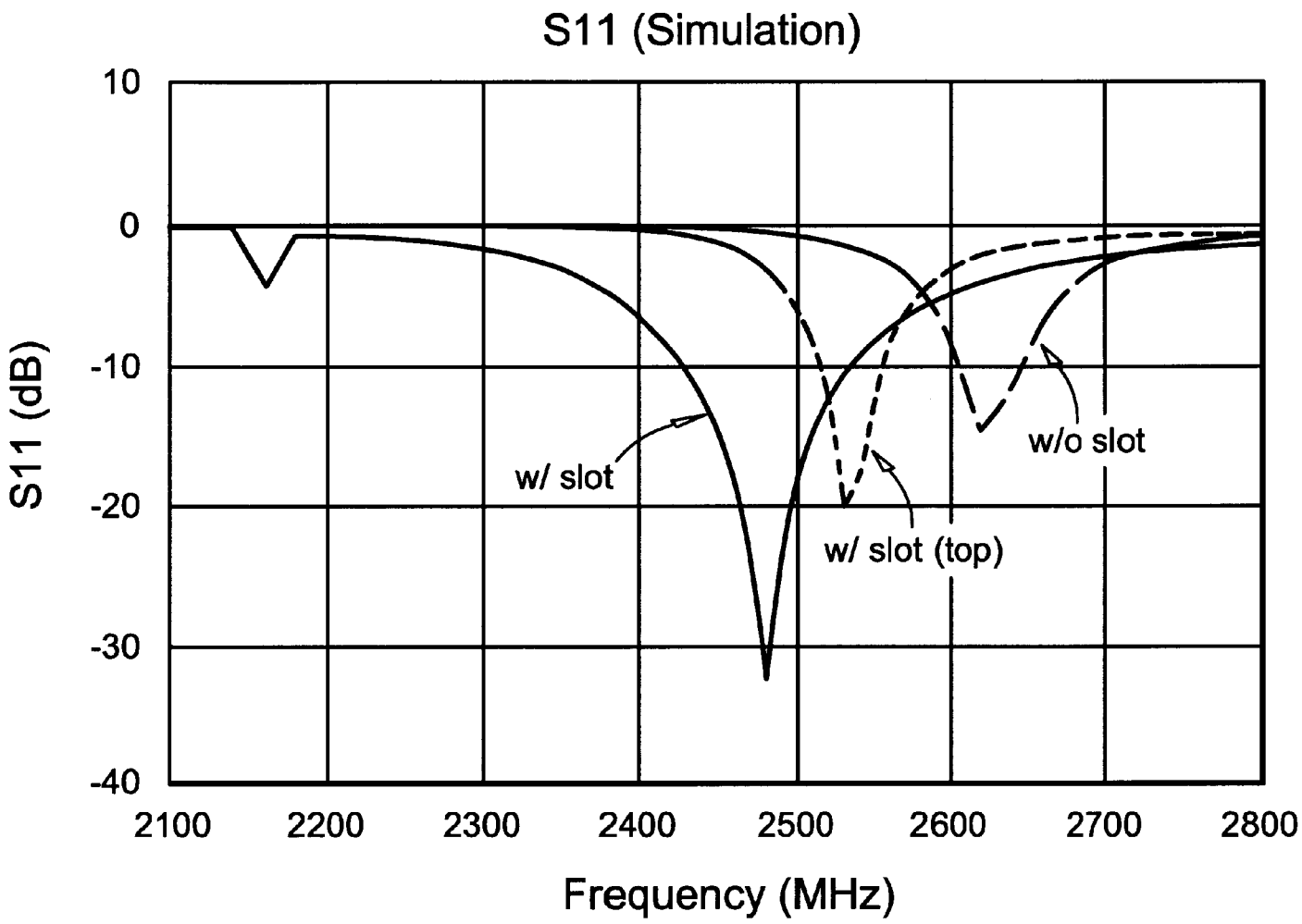
FIG. 3 is a graph showing simulative results of a relationship between a frequency and a return loss of a patch antenna of this invention and a conventional patch antenna to determine a bandwidth thereof.
Figure 6:
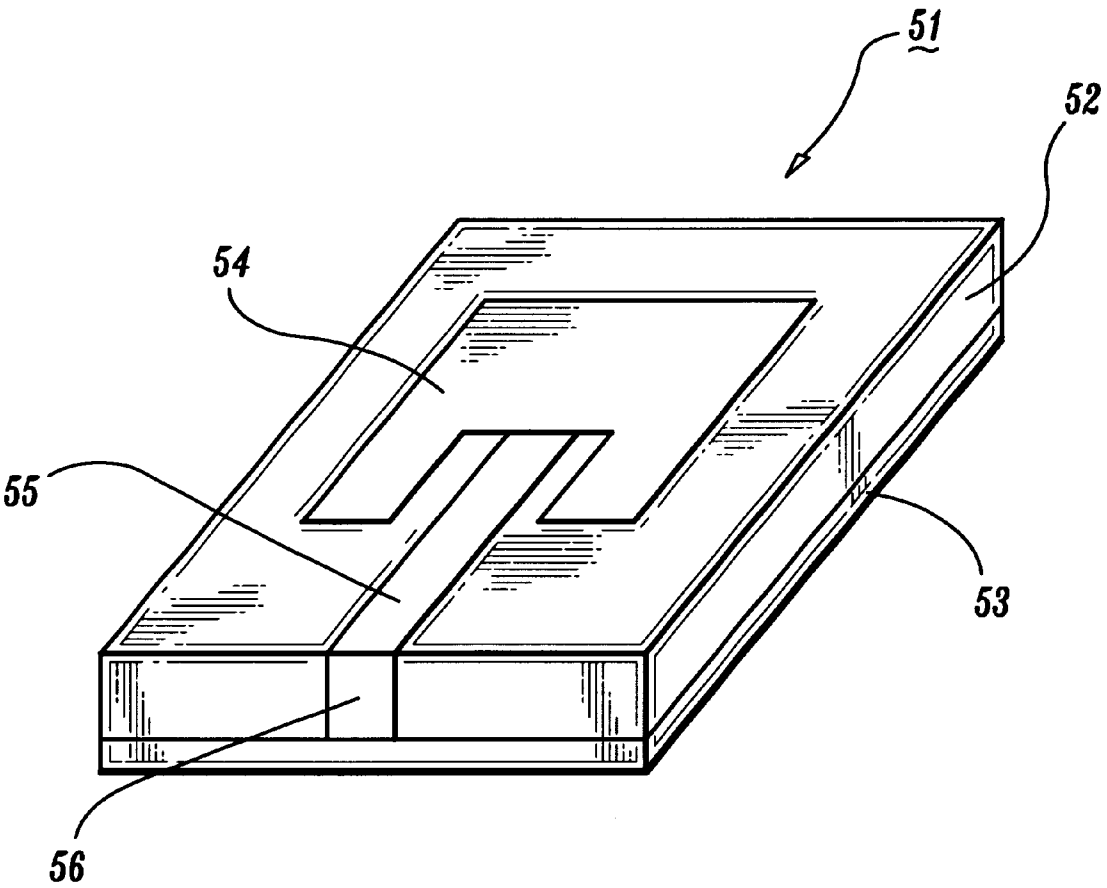
FIG. 6 is a perspective view of an exemplary structure of a conventional patch antenna.

In FIG. 3, there are shown simulative results of return losses (S11) for three examples, including: (1) a first example (w/slot), wherein the aperture 7 is provided in either one of the two areas among said four areas that are closer to the feeding line 5 as shown in FIG. 1; (2) a second example (w/slot (top)), wherein the aperture 7 is provided in either one of two areas among said four areas that are farther from the feeding line 5; and (3) a third example (w/o slot), wherein no aperture is provided as shown in FIG. 6. Note that the simulative results have been obtained by an EMI simulator, which is based on the "boundary element method/method of moment" developed by Rubin et al (B. J. Rubin, S. Daijavad: "Radiation and Scattering from Structures Involving Finite-Size Dielectric Regions," IEEE Trans. Antennas Propagat. AP-38, pp. 1863–1873 (1990)). Also, the results of FIG. 3 are summarized in Table 1 below.

TABLE 1

| | no slot | slot | slot (top) |
|---|---|---|---|
| Resonant Freq. | 2.62GHz | 2.48GHz | 2.53GHz |
| Bandwidth | 40MHz | 100MHz | 40MHz |

Considering return losses (S11) from the results shown in FIG. 3 and Table 1, it is observed that in the second example (w/slot (top)) with an aperture provided on the top and the third example (w/o slot) without any aperture, a bandwidth of S11 below −10 dB is nearly equal to 40 MHz, whereas in the first example (w/slot) with an aperture provided in close proximity to a feeding line, a bandwidth of S11 below −10 dB is nearly equal to 100 MHz. Thus, it can be seen that a bandwidth of a patch antenna may be broadened by means of providing an aperture at a predetermined position. Also, considering resonant frequencies, it is observed that in the first and second examples (w/slot, w/slot (top)) each with an aperture, their resonant frequencies are nearly equal to 2.48 GHz, 2.53 GHz respectively, whereas in the third example (w/o slot) without any aperture, its resonant frequency is nearly equal to 2.62 GHz. Thus, it can be seen that in case of designing patch antennas of the same resonant frequency, an exemplary patch antenna with an aperture may be significantly downsized than another exemplary patch antenna without any aperture. Note in this respect that actual results of return losses measured from the similar three different examples have substantially agreed with said results.

Figure 4:
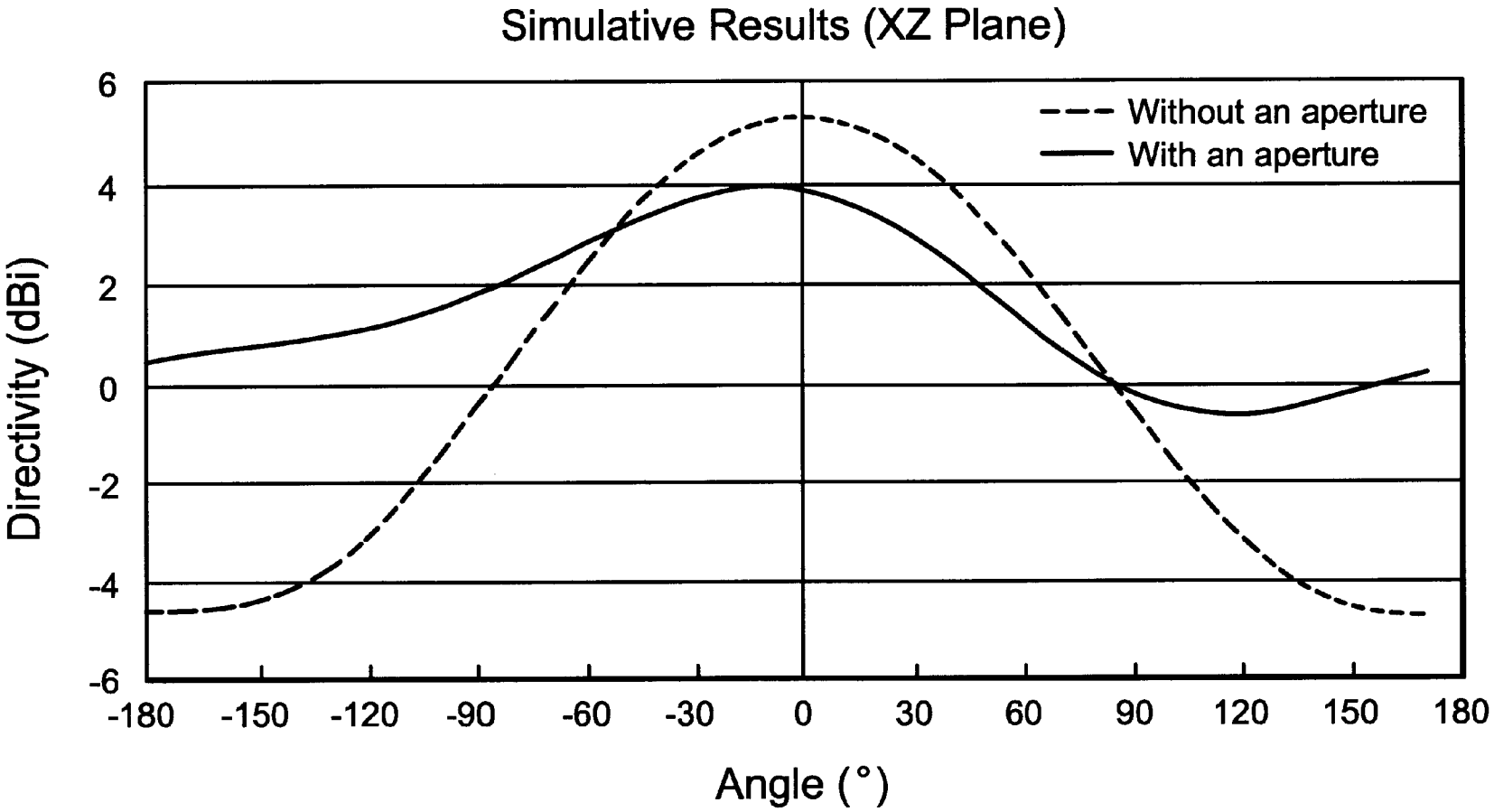
FIG. 4 is a graph showing simulative results of directivity of a patch antenna of this invention and a conventional patch antenna to determine a bandwidth thereof.
Figure 5:
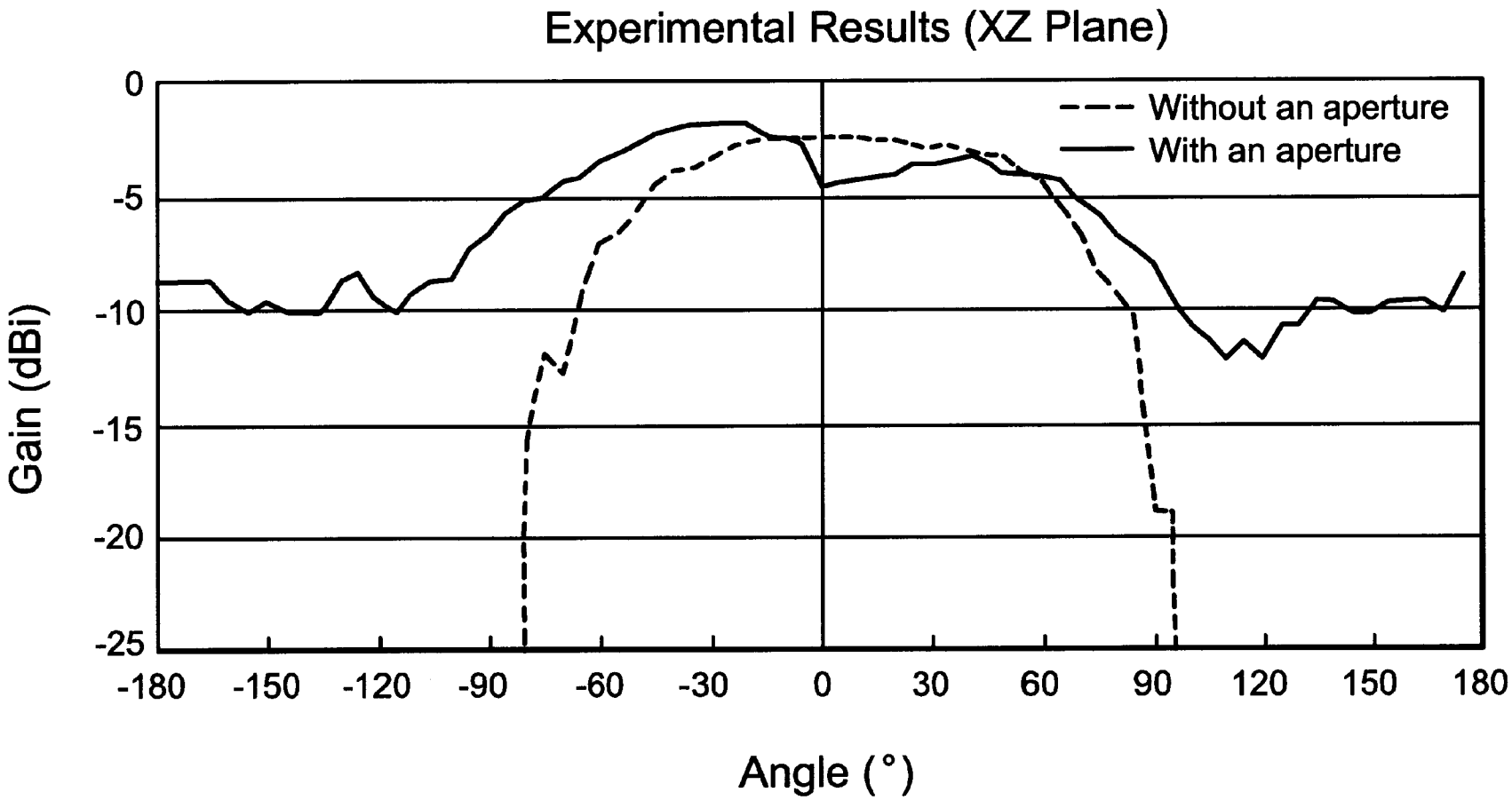
FIG. 5 is a graph showing results of actual gain measured for a patch antenna of this invention and a conventional patch antenna.

Next, for the first example (w/slot) with an aperture as shown in FIG. 1 and for the third example (w/o slot) without any aperture as shown in FIG. 6, their directivity on the XZ plane shown in FIG. 1(*a*)have been simulated. The simulative results are shown in FIG. 4. From the results of FIG. 4, it is observed that the directivity of the present patch antenna with an aperture, as taught by this invention, does not much vary among directions than that of the conventional patch antenna without any aperture, which leads to a reduction or absence of directivity of the present patch antenna. Similarly, for the first example (w/slot) with an aperture as shown in FIG. 1 and for the third example (w/o slot) without any aperture as shown in FIG. 6, their actual gain among directions, ranging from 0 to 360 degrees, on the XZ plane shown in FIG. 1(*a*) have been measured. The measured results are shown in FIG. 5. From the results of FIG. 5, it is also observed that the gain of the present patch antenna with an aperture, as taught by this invention, does not much vary among directions than that of the conventional patch antenna without any aperture, which leads to a reduction or absence of directivity of the present patch antenna. Note that, in case of the present patch antenna, its directivity has been changed from 5.3 dBi to 3.9 dBi (FIG. 4) by virtue of provision of an aperture, which demonstrates an improvement over the narrow directivity.

As seen from the above description, in accordance with this invention, it is possible to implement the non-directional and broad-bandwidth characteristics of a patch antenna by means of placing an aperture on a ground plate at a position, which is asymmetric about a center of the ground plate. Further, in accordance with this invention, it is possible to implement mobile communication and/or wireless LAN without worrying about positions of electronic equipment compared to installation of another antenna.

What is claimed is:

1. A patch antenna having a ground plate provided on one surface of a dielectric plate, and further having a patch and a feeding line connected to the patch, the patch and the feeding line provided on the other surface of the dielectric plate, the improvement comprising:

an aperture being provided on the ground plate at a position that is asymmetric about the center of the patch wherein the patch is logically divided into two halves in each of directions being parallel and perpendicular to the feeding line respectively to form four areas altogether, whereby the aperture is placed substantially in either one of the two areas that are closer to the feeding line.

2. The patch antenna of claim 1, wherein said aperture has a rectangular shape.

3. The patch antenna of claim 2, wherein a circumferential length along said aperture is substantially equal to one wavelength of a resonant frequency of the patch antenna.

4. The patch antenna of claim 1, wherein a circumferential length along said aperture is substantially equal to one wavelength of a resonant frequency of the patch antenna.

5. The patch antenna of claim 1 for use in a wireless local area network, the network for transmitting and receiving signals via the patch antenna between a personal computer and a host computer.

* * * * *